US006367492B1

(12) United States Patent
Brown

(10) Patent No.: US 6,367,492 B1
(45) Date of Patent: Apr. 9, 2002

(54) APPARATUS FOR RETAINING PLASTIC BAGS DURING WASHING

(76) Inventor: John D. Brown, 319 Morewood Pkwy., Rocky River, OH (US) 44116

( * ) Notice: Subject to any disclaimer, the term of this patent is extended or adjusted under 35 U.S.C. 154(b) by 0 days.

(21) Appl. No.: 09/222,218

(22) Filed: Dec. 29, 1998

Related U.S. Application Data

(60) Provisional application No. 60/070,060, filed on Dec. 30, 1997.

(51) Int. Cl.[7] ..... B08B 3/02

(52) U.S. Cl. ..... 134/166 R; 134/201; 134/170; 134/167 R

(58) Field of Search ..... 134/166 R, 201, 134/167 R, 168 R, 169 R, 170; 220/9.3; 248/95, 97, 99, 100, 101; 211/12, 13

(56) References Cited

U.S. PATENT DOCUMENTS

| | | | | |
|---|---|---|---|---|
| 2,908,463 | A | | 10/1959 | Chenette |
| 3,295,694 | A | | 1/1967 | Nejezchleb et al. |
| 3,826,455 | A | | 7/1974 | O'Donnell |
| 4,258,493 | A | | 3/1981 | Kettlestrings et al. |
| 4,299,365 | A | | 11/1981 | Battle |
| 4,440,430 | A | | 4/1984 | Kruse |
| 4,575,895 | A | | 3/1986 | Spellman |
| 4,741,534 | A | | 5/1988 | Rogahn |
| 4,826,059 | A | | 5/1989 | Bosch et al. |
| 4,846,427 | A | | 7/1989 | Jones |
| 4,901,959 | A | | 2/1990 | Stage |
| 4,921,193 | A | | 5/1990 | Benesch |
| 5,002,246 | A | | 3/1991 | Chaffin et al. |
| 5,060,893 | A | | 10/1991 | Halbert |
| 5,080,237 | A | | 1/1992 | Hefner |
| 5,102,076 | A | | 4/1992 | North et al. |
| 5,188,244 | A | | 2/1993 | Hollstegge |
| 5,275,363 | A | | 1/1994 | Dennis |
| 5,303,827 | A | | 4/1994 | Ross |
| 5,314,151 | A | | 5/1994 | Carter-Mann |
| 5,400,989 | A | * | 3/1995 | Gaskill |
| 5,405,018 | A | | 4/1995 | Anthrop, Jr. |
| 5,421,542 | A | | 6/1995 | Crutcher |
| 5,641,137 | A | | 6/1997 | Collier |
| 5,794,792 | A | * | 8/1998 | Convertino |
| 5,799,908 | A | * | 9/1998 | Downs |
| 5,918,651 | A | * | 7/1999 | Gazdy et al. |

* cited by examiner

*Primary Examiner*—Frankie L. Stinson
(74) *Attorney, Agent, or Firm*—Fay, Sharpe, Fagan, Minnich & McKee, LLP

(57) ABSTRACT

Apparatus for retaining a plastic bag in an opened condition to facilitate cleaning in an automatic dish washer for bag re-use. The apparatus includes an open, segmented framework defining a form structure over which a soiled bag is positioned. First and second parallel frame sidewalls are laterally spaced apart and interconnected such that the form structure corresponds generally in size and shape to the interior of a plastic bag to be positioned thereover so that the form will maintain the bag in an open state. The framework includes a first or upper end and a second or lower end. The upper end is inserted into the open mouth of a soiled plastic bag. The upper end of the framework converges or tapers slightly to facilitate ease of insertion into the open mouth of a soiled plastic bag. The form is inserted into the bag until the mouth of the bag is seated around the second end of the framework. A plurality of bag retaining clips are located at the framework lower end to releasably receive and firmly retain peripheral portions of the bag at the mouth area during bag washing in a dish washer. The framework may optionally be constructed in a manner that allows for selective collapsing for storage purposes and expansion for washing use.

12 Claims, 4 Drawing Sheets

FIG. 7
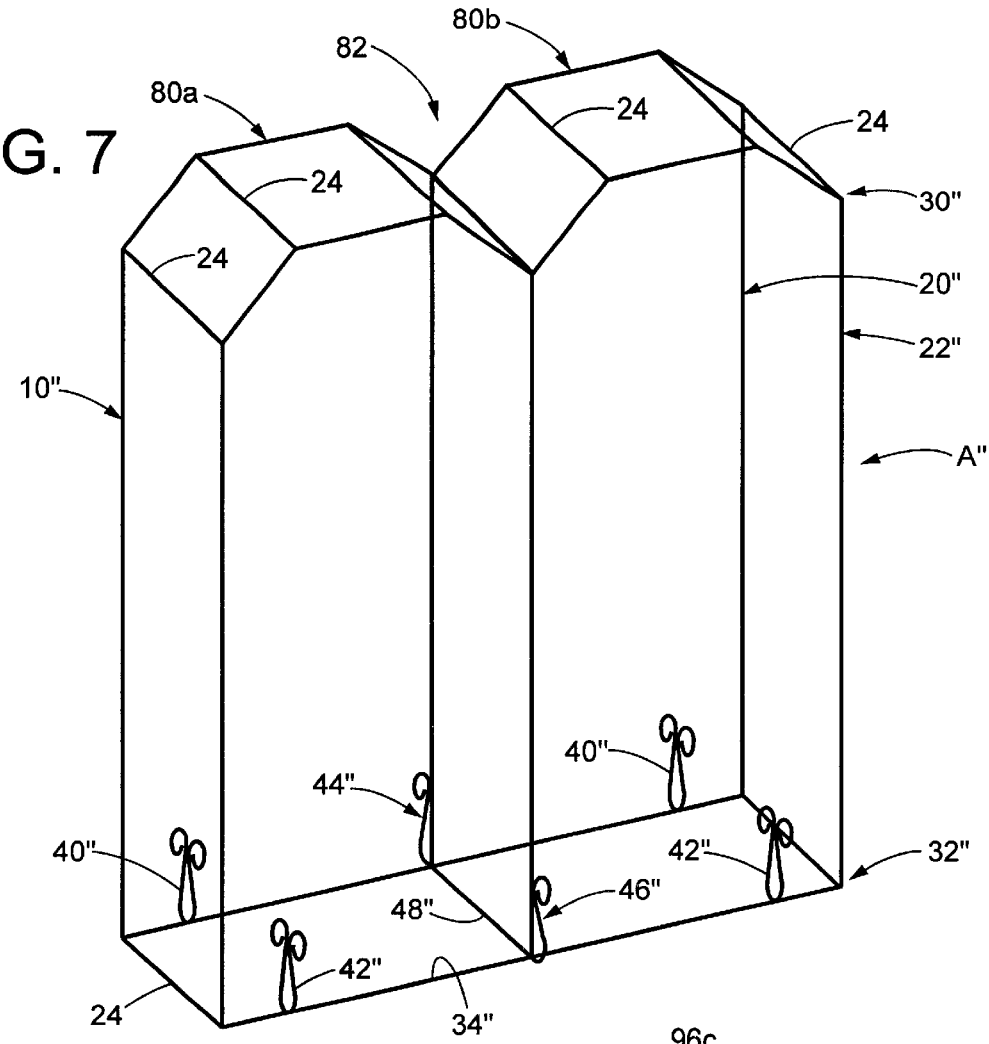
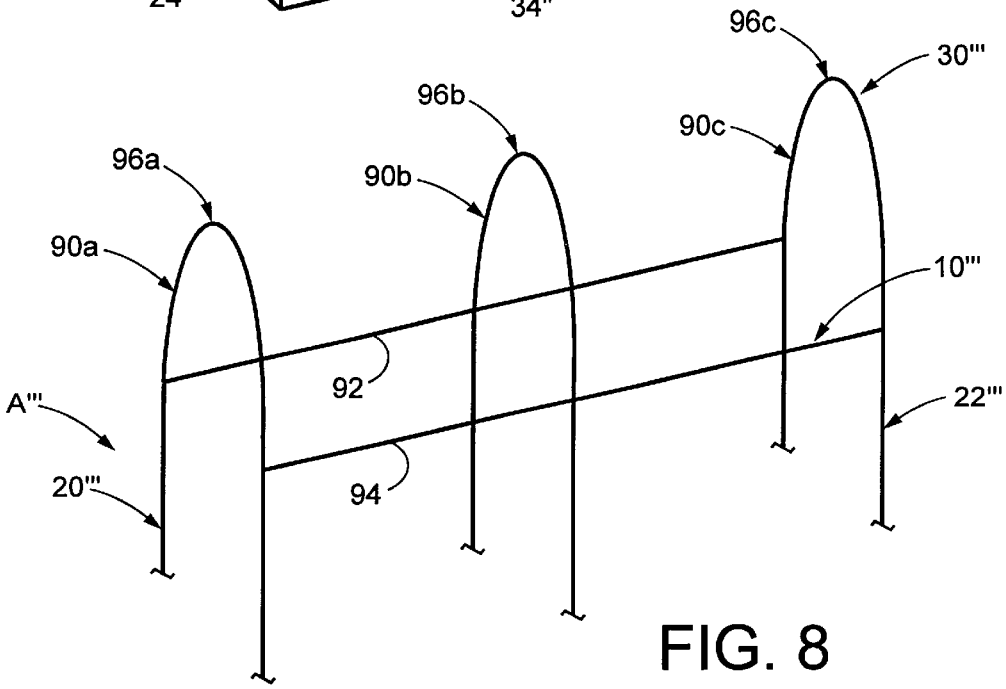
FIG. 8

APPARATUS FOR RETAINING PLASTIC BAGS DURING WASHING

CROSS-REFERENCE TO RELATED APPLICATION

This application claims priority from U.S. provisional application Ser. No. 60/070,060 filed Dec. 30, 1997.

BACKGROUND OF THE INVENTION

The present invention relates generally to the cleaning arts, and more particularly to an apparatus or device that facilitates washing of plastic bags for re-use. The invention finds particular application in association with the washing of food storage bags with reusable zip-type closure mechanisms and other such bags which are well-suited for repeated use.

Plastic food storage bags have enjoyed widespread popularity. These bags are typically made from clear, tough plastic and include a zip-type closure or seal mechanism at the bag mouth for sealing the bag in a fluid-tight manner. Over the years, these bags have become increasingly durable, to the point where they are now able to be used on multiple occasions. However, such bags continue to be marketed and used as single use "disposable" storage bags.

The disposability of the bags provides a source of convenience for bag users. Unfortunately, the bags can be costly and their disposal contributes large amounts of solid waste to already strained landfills. Further, these bags are made from petroleum-based plastics, and their manufacture further depletes the earth's finite oil supply.

A main cause of the premature disposal of these plastic bags is the lack of an effective and convenient apparatus for washing, rinsing, and drying the bags after they have been used for storage of food or the like. One prior approach is to manually wash the bag interior. In addition to being time consuming, unpleasant and often ineffective, the lack of suitable support for the bags during drying allows the bag walls to collapse together and trap moisture in the bag interior.

U.S. Pat. No. 3,295,694 relates to a drying rack for plastic bags that does maintain the bags in an inverted, open state to encourage the drying of the bag interior. However, this drying rack does not provide any means to facilitate convenient and effective bag washing.

U.S. Pat. No. 5,080,237 describes a device for maintaining a bag in an open, inverted state so that a user is able to manually direct a stream of water into the bag in an effort to dislodge residual food and other debris. With this device, a user must still manually wash the bag in a sink or other suitable location where over-spray is acceptable. Also, the cleaning spray is unlikely to provide effective cleaning. This prior apparatus is not suited for placement in an automatic dish washing apparatus for bag cleaning operations. In addition to its shape and size which are not compatible with most conventional dish washing equipment, this apparatus does not include any means for firmly securing the bag in position against the high pressure water jets typically associated with conventional dish washers.

Accordingly, it has been considered desirable to develop a plastic bag washing apparatus that facilitates convenient and effective bag washing in automatic dish washing apparatus. The subject invention is deemed to meet the foregoing needs and others, and provide a new and improved plastic bag washing apparatus that provides better and more advantageous overall results.

SUMMARY OF THE INVENTION

In accordance with a first aspect of the present invention, an apparatus or device for retaining a plastic bag in a desired position and orientation for washing an interior portion of the bag includes an open, segmented framework defining a form for insertion into the open mouth of a bag to be washed so that the form is disposed in an interior portion of the bag. The form maintains the bag mouth and interior portion open to receive cleaning fluid. The apparatus also includes means for releasably securing the bag relative to the framework against the forces of cleaning fluid flowing into and out of the bag interior.

In accordance with another aspect of the present invention, the apparatus or device facilitates effective washing of the interior of a plastic bag in an automatic dish washer. The device includes an open framework adapted for receipt in the bag interior through an open mouth portion thereof. The framework maintains the bag and mouth substantially open to receive washing fluid during the washing operation. The new apparatus or device also includes means for securing and retaining the bag in a desired orientation and position during washing.

One advantage of the present invention resides in a bag washing device that may be effectively used to facilitate superior plastic bag cleaning in a conventional automatic dish washer without damage to the apparatus or to a bag secured thereto by placement of the apparatus and associated bag in an upright position in the dinner plate rack of a dish washer with the mouth of the bag opened downwardly to allow entry of the high pressure jets of water and washing solution into the bag.

Another advantage of the invention is found in a plurality of bag retaining clips that releasably engage peripheral portions of the bag at the open mouth thereof without causing any damage to the bag. The clips are preferably formed with a slightly enlarged "home" position for ease of insertion and removal of the plastic zipper portion of a conventional plastic storage bag such that the zipper is securely held without damage thereto or to other bag portions. Forceful fluid jets of a dish washing machine are able to clean the inside of a secured bag without dislodging the bag from its operative washing position and without damaging the plastic welds forming the bag structure.

Still another advantage of the present invention is found in the tapered first end which is easily received within a soiled bag and which does not trap food and other debris in the bag during the washing, rinsing or drying cycles.

A further advantage of the present invention results from an apparatus construction which may be collapsed or folded for storage when not in use.

Yet another advantage of the invention is the provision of a framework structure that encourages the free flow of liquid and air throughout the interior of a bag operatively associated therewith.

Another advantage to the invention is that the apparatus and bag to be washed can be placed in the dinner plate rack of a standard dish washing machine and maintained in a stable and upright position throughout the washing, rinsing and drying cycles for effective cleaning and drying. The bag will not be "blown off" the apparatus by the high pressure water jets, nor will the apparatus with the attached bag be tipped over or otherwise moved out of the operative washing/drying position.

A further advantage of the invention is that neither the apparatus itself, nor the bag cleaning/drying operations, cause damage to the bag. As such, plastic bags may be used and washed multiple times in order to benefit the environment and to lower the overall expense associated with the use of plastic storage bags.

Still other benefits and advantages of the present invention will become apparent to those of ordinary skill in the art upon reading and understanding the present specification.

BRIEF DESCRIPTION OF THE DRAWING

The invention may take physical form in certain parts and arrangements of parts, preferred embodiments of which will be described in detail in this specification and illustrated in the accompanying drawings which form a part hereof wherein:

FIG. 7 is a simplified perspective view of a second alternative embodiment formed in accordance with the present invention; and, FIG. 8 is a partial perspective view of a third alternative embodiment formed in accordance with the present invention.

DETAILED DESCRIPTION OF THE INVENTION

Figure 1:
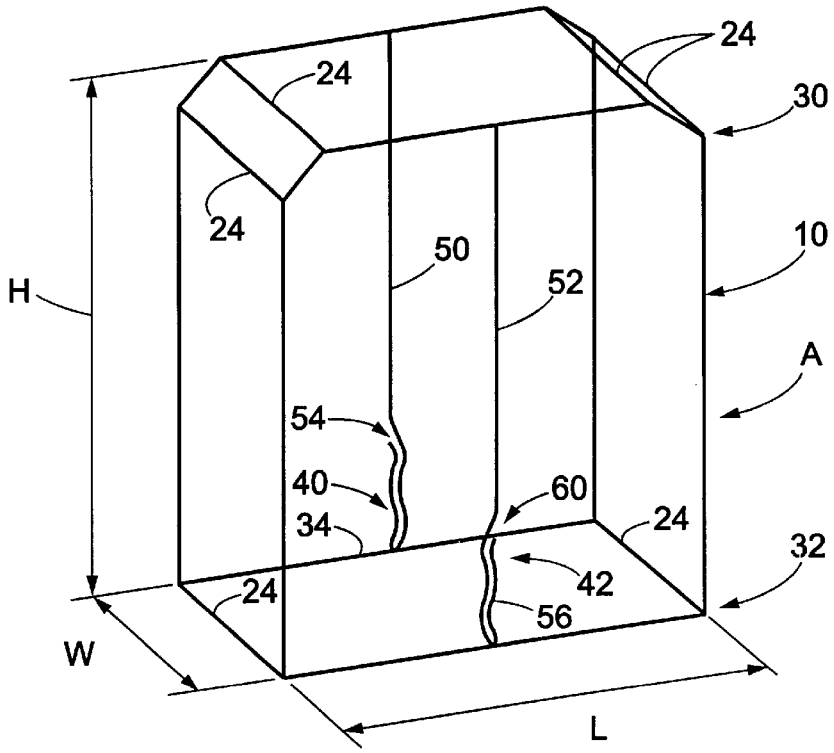
FIG. 1 is a simplified perspective view of a bag washing apparatus formed in accordance with a first embodiment of the present invention.
Figure 2:
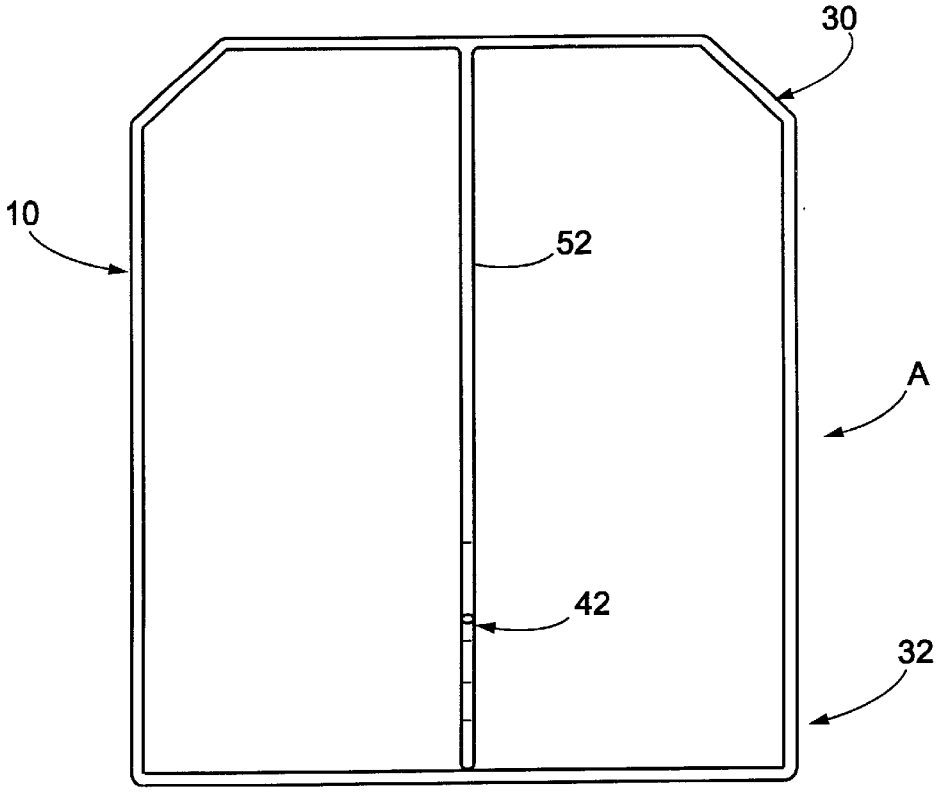
FIG. 2 is a front elevational view of the bag washing apparatus depicted in FIG. 1.

Referring now to the drawings wherein the showings are for purposes of illustrating preferred embodiments of the invention only and not for purposes of limiting the same, FIG. 1 illustrates a bag washing apparatus or device A comprising an open, segmented framework 10 that defines a form over which a soiled bag is received for washing purposes. The framework is preferably constructed from thin, elongated segments of a durable and corrosion resistant material such as plastic, a suitable metal such as aluminum or stainless steel, or a metal coated with vinyl or other suitable material. Conventional manufacturing techniques which do not form a part of the present invention may be satisfactorily employed.

With reference to FIGS. 1–4, the framework 10 comprises first and second laterally spaced-apart sidewalls 20,22 (FIGS. 3 and 4) interconnected by a plurality of tie members or segments 24 disposed in parallel relation to each other at preferred spaced intervals around the sidewalls. The sidewalls are preferably at least substantially identical to each other having a length L and a height H, and are distanced from each other by a width W. Those skilled in the art will recognize that the particular dimensions L,H,W of the framework 10 will vary depending on the size of bag to be positioned thereover. It is contemplated that the subject apparatus will commonly be used to clean conventional resealable freezer storage bags measuring approximately 11.75 inches by 10.6 inches. To clean such bags, the framework 10 is preferably manufactured to have an approximate height H in the range of 10–11 inches, an approximate length L in the range of 8–8.5 inches, and an approximate width W in the range of 1.25–1.5 inches. It will be readily appreciated, however, that the concepts of the subject invention are equally applicable to other shapes and sizes of bags. In any case, the framework 10 must be sized and shaped to be at least substantially received within the interior of the bag being cleaned so that the bag is able to be retained in the operative washing position as described below.

To facilitate insertion of the framework 10 into a soiled bag without damage to the bag welds, seams, or other portions, first or upper end 30 is tapered in a manner converging away from a framework second or lower end 32. As such, the framework upper end 30 is adapted for easy insertion into an open mouth of a bag to be cleaned. It is preferable that, upon full insertion, the portion of the bag defining the open mouth surrounds the framework generally at lower portion 32 and is maintained in an open condition thereby. The framework lower portion 32 thus defines an open, unobstructed entrance 34 (FIG. 4) which communicates with the open mouth of a bag positioned over the framework 10. Because the bag washing apparatus is particularly adapted for placement in an automatic dish washing apparatus for purposes of cleaning a bag secured thereto, it is preferable that the framework lower portion 32 be defined by a closed rectangular conformation which advantageously allows the framework 10 to sit level and securely on an open framework surface of a dish rack as is commonly found in a modern automatic dish washing apparatus. This preferred, closed rectangular configuration prevents portions of the framework 10 from extending or falling through the support rack of the dish washer. Those skilled in the art will recognize that, with the framework 10 inserted into a bag as described, washing and rinsing solutions, as well as air, are permitted to enter and exit the bag and circulate throughout the interior thereof. The open, segmented construction of the framework 10 minimizes contact between the framework and the bag which can lead to trapped food and other debris, and readily facilitates unobstructed circulation of liquid and gas in the bag interior.

Device or apparatus A, with a soiled bag positioned thereover, is particularly well-suited for placement in an automatic dish washing apparatus for washing, rinsing and drying of the bag. The preferred framework dimensions as described above are compatible with the majority of conventional dish washing apparatus. A width W of approximately 1.5 inches or less allows the framework to be conveniently received in that section of a dishwasher commonly used to retain plates. There, open lower end 34 of the apparatus A is oriented downward so that the streams or jets of wash and rinse liquid are directed upwardly into an associated bag, and for draining of the bag.

In addition to its preferred dish washer compatible dimensions, the apparatus A also advantageously includes means for releasably securing and retaining a bag in the operative washing position while resisting the force of the high-pressure liquid streams encountered in such washing apparatus. To that end, and as shown in FIG. 14, first and second bag retaining clips 40,42 are provided in cooperative association with support segments 50,52 centrally located relative to the sidewalls 20,22, respectively, and extending along height dimension H. As shown, clips 40,42 are positioned on opposite lateral sides of the framework lower region 32. Each clip releasably receives and retains a peripheral portion of a bag which defines the bag mouth when the bag is operatively positioned over the framework A. Such arrangement prevents the bag from being dislodged or "blown-off" of the apparatus A during washing operations and prevents damage to the welds forming the lateral seams of the bag.

The clips 40,42 may be provided in a wide variety of suitable forms. As shown, however, the clips are each formed by bending a terminal portion 54,56 of each support segment 50,52 back upon itself so that the terminal portions thereof closely overlie lower portions of segments 50,52. Each terminal portion 54,56 thus defines a slot 60 with its associated support segment 50,52 for receiving a peripheral portion of an associated bag, in particular, the plastic zipper closure commonly found on plastic storage bags, without causing damage thereto. Preferably, the terminal portions 54,56 are resiliently biased inwardly against the support segments 50,52, respectively, so that a bag portion received in the slot 60 is frictionally retained between the terminal portions 54,56 and the associated one of segments 50,52.

Figure 3:
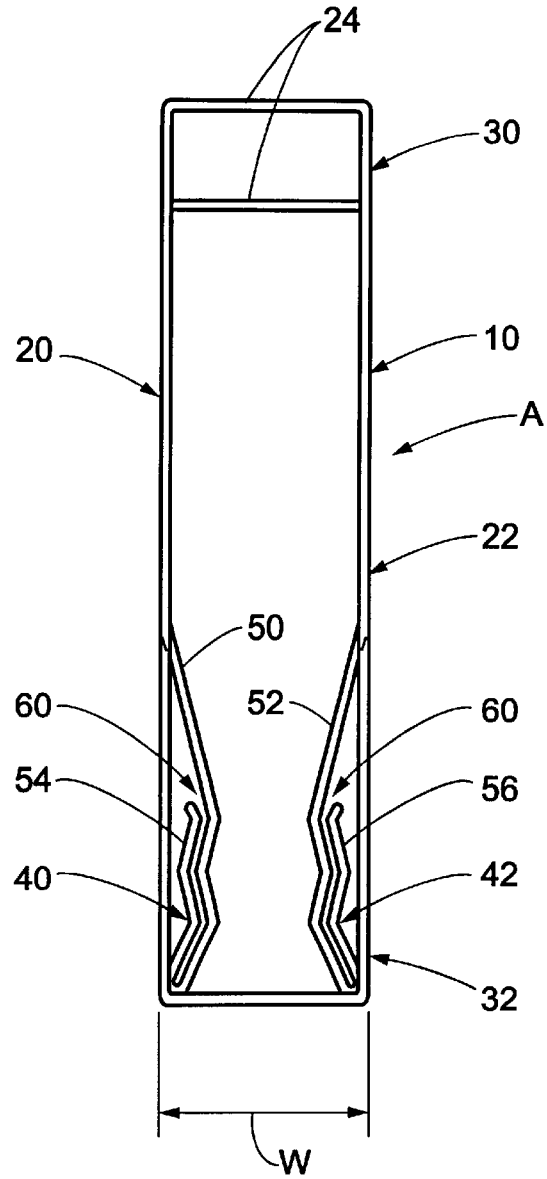
FIG. 3 is a side elevational view of the bag washing apparatus of FIG. 1.
Figure 4:
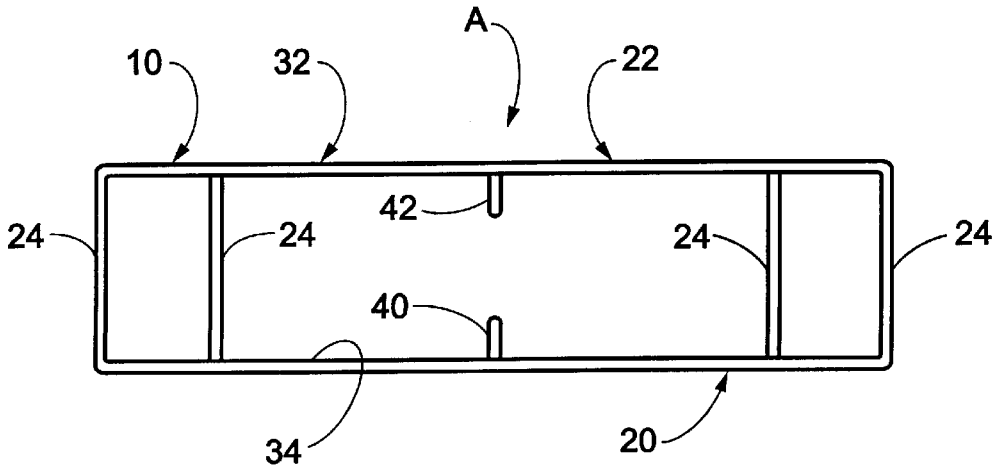
FIG. 4 is a bottom plan view of the bag washing apparatus of FIG. 1.

As is shown most clearly in FIG. 3, the support segments and the associated terminal portions 54,56 define the slot to be irregular in shape, e.g., in a curved or "zig-zag" fashion, to further resist upward movement of the bag out of the slot and to spread the bag gripping forces over a larger surface area to minimize the potential for bag damage. Of course, other suitable clip structures may be used to releasably retain a bag in the operative washing position without departing from the overall scope and intent of the present invention.

With continuing reference to FIG. 3, it is shown that the clips 40,42 do not protrude outwardly beyond the plane of the sidewalls 20,22, respectively. This, then, ensures that the clips 40,42 do not interfere with insertion or removal of the apparatus A into and out of a dish washing apparatus. More particularly, the support segments 50,52 are indented slightly inward from the plane of their respective sidewalls 20,22 so that the clips formed thereby are likewise indented.

Figure 5:
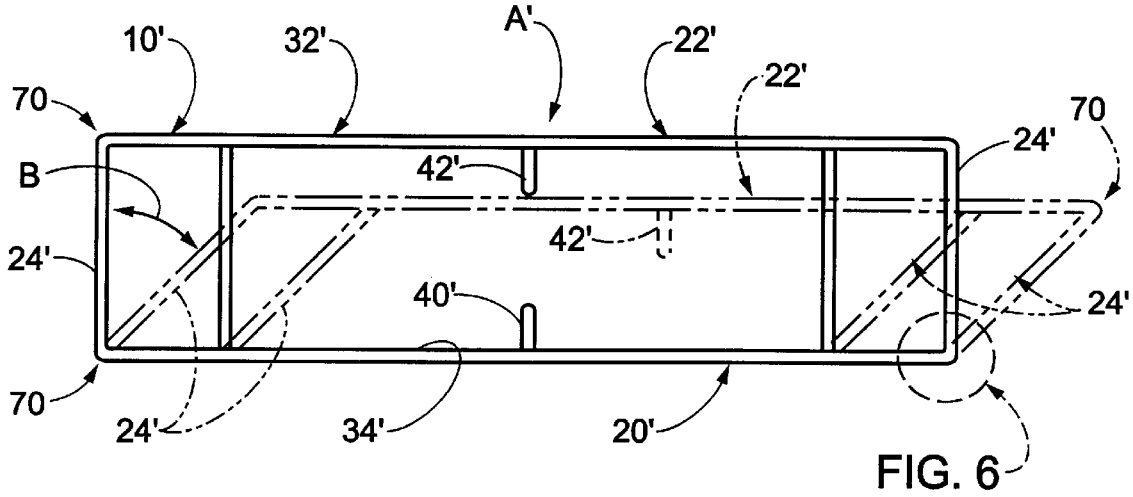
FIG. 5 is a bottom plan view similar to FIG. 4 illustrating a first alternative embodiment of a bag washing apparatus in a collapsed or folded condition for convenient storage as shown in phantom.
Figure 6:
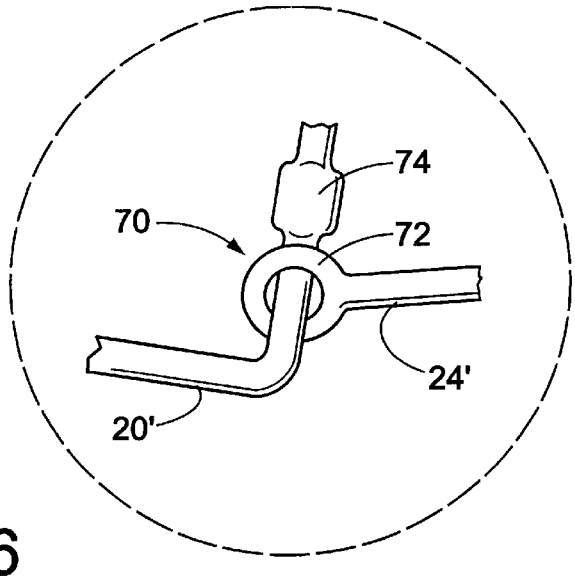
FIG. 6 is a partial perspective view illustrating a suitable hinge used to construct the apparatus shown in FIG. 5.

FIGS. 5 and 6 illustrate an alternative bag washing apparatus A' formed in accordance with the overall concepts of the present invention. Except as described herein, the apparatus A' is similar to the apparatus A. Accordingly, for ease of reference, like components of the apparatus A' are referenced with like reference numerals including a primed (') suffix and new components are identified by new numerals.

To facilitate storage of the apparatus A', the framework 10' is constructed to be selectively collapsible or foldable. The framework sidewalls 20',22' are hingedly connected to the tie segments 24' by convenient means such that the sidewalls 20',22' pivot relative to each other on an arc B between an operative bag washing position and a collapsed storage position as shown in phantom lines in the bottom view FIG. 5. The hinges 70 connecting each sidewall 20',22' to the tie segments 24' may take a variety of forms within the scope and spirit of the invention.

One suitable hinge structure is illustrated in FIG. 6 and comprises the inclusion of a closed loop or "eye" 72 at opposite ends of each tie member 24'. Eyes 72 are respectively connected to a segment of the first and second sidewalls. Only the first sidewall 20' is shown in FIG. 6 with an eye 72 disposed in a rotatable relationship therewith for allowing pivoting or rotating action in the manner described. One or more deformed portions 74 or other means prevent undesirable excessive axial sliding movement of the eye 72 along the associated portion of sidewall 20'. While only one eye 72 and deformed portion 74 have been shown, it is to be understood that the other of the tie members 24' have similar eyes with deformed portions. It will also be appreciated that many other types and styles of pivotal connections and portion retaining means could also be used to advantage without departing from the overall intent or scope of the invention. When the apparatus A' is expanded into the operative bag washing position, the presence of the bag itself, once secured as described, prevents the apparatus A' from collapsing into the storage position.

FIG. 7 illustrates another alternative bag washing apparatus A" in accordance with the present invention. Apparatus A" is similar to the previously described apparatus, so like components are again identified with like reference numerals including a double-primed (") suffix and new components are identified with new numerals.

The apparatus A" includes an open, segmented framework 10" having an upper portion 30" that includes first and second converging or tapered portions 80*a*,80*b*. These tapered portions facilitate insertion of the end 30" into a soiled bag, but also define a gap 82 therebetween that increases the flow of washing fluid and air in the bag being cleaned. In particular, the formation of the gap 82 lessens the amount of the framework 10" that is in contact with the bag interior, and thus decreases the likelihood of food or other debris being trapped in the bag.

The framework 10" also includes a plurality of bag retaining clips 40",42" connected to the lower end 32" thereof. The clips are made from a suitable resilient metal or plastic and releasably receive and retain portions of a bag during washing operations. The clips are preferably spaced-apart and located on opposite lateral sides of the framework entrance 34" such that a bag positioned over the framework is more evenly and firmly secured in position.

As shown in FIG. 7, it has been found desirable to fabricate the clips 40",42" separately from the remainder of the framework 10", and to affix the clips to the framework at spaced intervals where desired. This construction prevents weakening of the clips or reducing their resiliency due to welding, bending, and/or other manufacturing processes associated with fabrication of the framework 10". Furthermore, first and second clips 44",46" can be formed in association with the opposite lateral sides 20",22" of the framework 10" by securing a single clip member 48" to the framework 10" so that opposite ends thereof lie adjacent to those framework members forming the sidewalls 20",22", respectively.

FIG. 8 illustrates a third alternative embodiment of a bag washing apparatus formed in accordance with the present invention. Except as shown and described hereinbelow, the apparatus A'" is similar in all respects to the apparatus A, A', A". For this reason, only the first or upper portion 30'" of the apparatus A'" is illustrated. Again, like components of the apparatus A'" relative to those previously described are identified with like reference numerals including a triple-primed ('") suffix and new components are identified with new reference numerals.

Apparatus A'" includes an open, segmented framework 10'" defined by a plurality of laterally spaced-apart and inverted U-shaped members 90*a*,90*b*,90*c*. The members 90*a*–90*c* are interconnected by one or more laterally extending cross-members 92,94 forming a part of the first and second sidewalls 20'",22'", respectively. The inverted U-shaped members respectively include smoothly rounded closed ends 96*a*, 96*b*, and 96*c* that mutually define the first end 30'" of the framework to have a smoothly curved or rounded and possibly tapered shape for ease of insertion into an associated bag without risk of bag damage.

The invention has been described with reference to preferred embodiments. Obviously, modifications and alterations will occur to others upon reading and understanding the preceding specification. It is intended that the invention be construed as including all such modifications and alterations insofar as they fall within the scope of the appended claims.

Having thus described the preferred embodiments, the invention is claimed to be:

1. An apparatus for retaining a plastic bag in a desired position to accommodate washing at least an interior portion of the bag, said apparatus comprising:

an open, segmented framework defining a form adapted for insertion into a bag to be washed through an open mouth thereof so that said form maintains said mouth and an interior portion of said bag in an open condition for allowing entry and exhaust of cleaning fluid from said interior portion, said framework comprising a tapered first end, a second end and sidewall segments extending between said first and second ends, said sidewall segments defining first and second opposite lateral sidewalls of said framework; and, a plurality of bag retention clips located adjacent said second end of said framework and adapted to selectively secure an associated bag to said framework in a desired orientation against the force of cleaning fluid flowing into and out of the bag interior portion, each of said clips defined by a terminal portion of a sidewall segment folded back upon itself so that said terminal portion and a remaining portion of said sidewall segment define a bag-receiving slot therebetween, said terminal portion resiliently biased into adjacency with said remaining portion and movable toward and away from said remaining portion of said sidewall segment.

2. The apparatus as set forth in claim 1 wherein said first end of said framework comprises separate first and second tapered portions each converging away from the framework second end, said first and second tapered portions defining a gap laterally therebetween adapted to increase the flow of cleaning fluid throughout the interior portion of an associated bag.

3. The apparatus as set forth in claim 1 wherein said framework second end defines an open, unobstructed entrance adapted to fluidly communicate with the interior portion of an associated bag into which said framework is inserted.

4. The apparatus as set forth in claim 1 wherein said framework comprises first and second laterally spaced-apart and parallel sidewalls interconnected by a plurality of tie members.

5. The apparatus as set forth in claim 4 wherein said tie members are positioned at spaced intervals around peripheral portions of said sidewalls and arranged to be substantially perpendicular to the planes defined by said sidewalls at least when said apparatus is disposed in operative relation to an associated bag to be cleaned.

6. The apparatus as set forth in claim 4 wherein said tie members are selectively shiftable between a first storage position with said first and second sidewalls closely spaced toward each other and a second operative position with said tie members arranged substantially perpendicular to the planes defined by said sidewalls.

7. The apparatus as set forth in claim 6 wherein a plurality of hinges interconnect said tie members to said first and second sidewalls for allowing pivotal movement of said tie members as said sidewalls are moved between said first storage and second operative positions.

8. The apparatus as set forth in claim 1 wherein the terminal portion and the remaining sidewall portion of each clip define mating irregular conformations.

9. The apparatus as set forth in claim 1 wherein said framework is defined by thin, elongated segments comprised of one of plastic and corrosion-resistant metal.

10. An apparatus for facilitating washing at least an interior portion of an automatic of an associated bag in an automatic dish washer, said apparatus comprising:

an open framework adapted for receipt in an interior of an associated bag through a mouth portion thereof so that said framework maintains the associated bag in an operative position substantially open to receive and exhaust washing fluid, said framework defined by a plurality of interconnected parallel and laterally spaced-apart inverted U-shaped members, said U-shaped members including respective tapered closed ends that together define said framework to have a tapered first end; and, a plurality of resilient clip members located at an opposite end of said framework relative to said tapered first end and adapted for securing an associated bag in said operative position relative to said framework, each of said plurality of clip members defined as a one-piece construction with and resiliently movable relative to one of said inverted U-shaped members defining said framework, wherein each of said plurality of clip members is defined by a portion of a U-shaped member that is turned back upon itself.

11. The apparatus as set forth in claim 10 further comprising:

means for selectively collapsing said open framework to a reduced size for storage.

12. The apparatus as recited in claim 10 wherein said open framework is defined by a plurality of interconnected segments, at least some of said segments interconnected by hinges so that said framework selectively folds into a reduced-size configuration for storage.

* * * * *